US005631126A

United States Patent [19]

Daubendiek et al.

[11] Patent Number: 5,631,126

[45] Date of Patent: *May 20, 1997

[54] EPITAXIALLY SENSITIZED TABULAR GRAIN EMULSIONS CONTAINING SPEED/FOG SULFODIHYDROXY ARYL ENHANCING ADDENDA

[75] Inventors: Richard L. Daubendiek; Jeffrey L. Hall, both of Rochester; Melvin M. Kestner, Hilton, all of N.Y.

[73] Assignee: Eastman Kodak Company, Rochester, N.Y.

[ * ] Notice: The term of this patent shall not extend beyond the expiration date of Pat. No. 5,503,971.

[21] Appl. No.: 363,477

[22] Filed: Dec. 23, 1994

[51] Int. Cl.[6] ..... G03C 1/08; G03C 1/34

[52] U.S. Cl. ..... 430/567; 430/607; 430/611; 430/613

[58] Field of Search ..... 430/567, 611, 430/607, 613

[56] References Cited

U.S. PATENT DOCUMENTS

| | | | |
|---|---|---|---|
| 2,131,038 | 9/1938 | Brooker et al. | 95/7 |
| 2,239,284 | 4/1941 | Draisbach | 95/7 |
| 2,716,062 | 8/1955 | Carroll et al. | 95/7 |
| 3,236,652 | 2/1966 | Kennard et al. | 96/109 |
| 3,295,976 | 1/1967 | Abbott et al. | 96/55 |
| 3,300,312 | 1/1967 | Willems et al. | 96/85 |
| 3,397,987 | 8/1968 | Luckey et al. | 96/109 |
| 4,414,306 | 11/1983 | Wey et al. | 430/569 |
| 4,435,501 | 3/1984 | Maskasky | 430/434 |
| 4,439,520 | 3/1984 | Kofron et al. | 430/434 |
| 5,087,555 | 2/1992 | Saitou | 430/567 |
| 5,219,721 | 6/1993 | Klaus et al. | 430/569 |
| 5,250,403 | 10/1993 | Antoniades et al. | 430/505 |
| 5,252,442 | 10/1993 | Dickerson et al. | 430/567 |
| 5,358,840 | 10/1994 | Chaffee et al. | 430/567 |
| 5,418,125 | 5/1995 | Maskasky | 430/567 |

FOREIGN PATENT DOCUMENTS

| | | | |
|---|---|---|---|
| 649099 | 12/1964 | Belgium | 430/607 |
| 0566074 | 10/1993 | European Pat. Off. | G03C 1/07 |
| 623448 | 5/1949 | United Kingdom . | |
| 691715 | 5/1953 | United Kingdom . | |

*Primary Examiner*—Lee C. Wright
*Attorney, Agent, or Firm*—Paul A. Leipold

[57] ABSTRACT

The invention relates to a radiation-sensitive silver halide emulsion comprising silver halide grains including tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and a spectral sensitizing dye adsorbed to the surfaces of the tabular grains, wherein the surface chemical sensitization sites include at least one silver salt epitaxially located on said tabular grains adsorbed onto said grains during grain forming or sensitizing and said emulsion further comprising at least one sulfodihydroxy aryl compound represented by the Formulas I or II

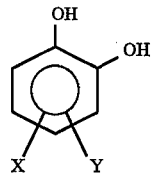

(Formula I)

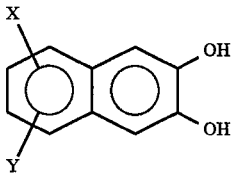

(Formula II)

wherein

X and Y represent an $SO_3$ group or a hydrogen with at least one of X and Y being a sulfo group.

15 Claims, No Drawings

EPITAXIALLY SENSITIZED TABULAR GRAIN EMULSIONS CONTAINING SPEED/FOG SULFODIHYDROXY ARYL ENHANCING ADDENDA

FIELD OF THE INVENTION

This invention relates to silver halide photographic emulsions, specifically to epitaxially sensitized tabular grain photographic emulsions containing stabilizing addenda that include dihydroxy aryl compounds having one or more sulfo substituent(s), alone or in combination with a mercaptotetrazole such as acetamidophenyl mercaptotetrazole. These stabilizing compounds enhance the speed/fog (Dmin) performance of said epitaxially sensitized emulsions.

BACKGROUND OF THE INVENTION

The ability to discriminate between exposed and unexposed areas of film or paper is the most basic requirement of any photographic recording device. In a normal sequence, the exposed photographic element is subjected to a chemical developer, wherein a very large amplification is effected through production of metallic silver as a result of catalytic action of small latent image centers that are believed to be small silver or silver and gold clusters. The resulting silver then forms the final image in many black and white products, or oxidized developer resulting from the silver reduction reaction can be reacted with couplers to form image dye. In either case, because of the thermodynamic driving force of the chemical developer to reduce silver halide to silver, it is not surprising that achievement of the desired discrimination between exposed and unexposed regions of a photographic element continues to challenge photographic scientists: Any non-image catalytic center will facilitate the unwanted production of metallic silver and image dye in unexposed areas during the development process. These non-image catalytic centers can come from one or more of various sources; for example, they may be the result of an inadvertant reductive process that generates Ag centers, they may be silver sulfide or silver/gold sulfide centers that result from inadvertant oversensitization, or they may result from trace metals such as iron, lead, tin, copper, nickel and the like from raw materials and/or manufacturing equipment.

Because there can be a variety of causes of photographic fog, a number of methods have been devised to combat it. One approach is to add one or more oxidants at various stages of the manufacturing process. Such oxidants include, for example, hydrogen peroxide or precursors of it, halogen or halogen releasing compounds, mercuric ion, or dichalcogenides such as bis(p-acetimidophenyl) disulfide (U.S. Pat. No. 5,219,721—Klaus or European Patent Application 0 566 074 A2—Kim). Selected oxidants are especially useful in minimizing reductive type fog.

A second approach involves addition of organic materials that tightly adsorb to the surfaces of silver halide light sensitive crystals, often through formation of sparingly soluble adducts with silver ion. Commonly used materials include, for example, tetraazaindenes (Carroll et al U.S. Pat. No. 2,716,062), benzothiazoliums (Brooker et al U.S. Pat. No. 2,131,038; Allen U.S. Pat. No. 2,694,716), or mercaptotetrazoles (Abbott et al U.S. Pat. No. 3,295,976; Luckey U.S. Pat. No. 3,397,987). While such materials can minimize reduction of silver halide to silver by reducing the silver ion concentration, they are also presumed to block those portions of the AgX surface to which they are adsorbed, thereby arresting the chemical sensitization and preventing the buildup of silver sulfide or silver gold sulfide centers to a size that allows them to become capable of catalyzing the silver development process.

A third approach utilizes complexing agents that are presumed to sequester metals, thereby mitigating their fogging propensity. Such agents include, for example, sulfocatechol-type materials (Kenard et al, U.S. Pat. No. 3,236,652), aldoximes (Carroll et al, U.K. Patent 623,448), meta and poly-phosphates (Draisbach, U.S. Pat. No. 2,239,284), carboxyacids (U.K. Patent 691,715) or sulfo-salicyclic acid type compounds (Willems, U.S. Pat. No. 3,300,312).

In recent years, the utility of tabular grain emulsions has become evident following disclosures of Kofron et al (U.S. Pat. No. 4,439,520). An early cross-referenced variation on the teachings of Kofron et al was provided by Maskasky (U.S. Pat. No. 4,435,501) Maskasky demonstrated significant increases in photographic sensitivity as a result of selected site sensitizations involving silver salt epitaxy. Still more recently, Antoniades et al (U.S. Pat. No. 5,250,403) taught the use of ultrathin tabular grain emulsions in which the tabular grains have an equivalent circular diameter (ECD) of at least 0.7 μm and a mean thickness of less than 0.07 μm, and in which tabular grains account for greater than 97 percent of the total grain projected area. Kodak patent applications now on file teach epitaxial sensitization of ultrathin tabular emulsions in which the host and epitaxy have preferred composition or dopant management (Daubendiek et al U.S. Ser. Nos. 296,841; 297,430 [Daubendiek II]); and 297,195 all filed Aug. 26, 1994, and Olm et al U.S. Ser. No. 296,562 filed Aug. 26, 1994).

Epitaxially sensitized emulsions in general, and epitaxially sensitized ultrathin tabular emulsions in particular, present some unique challenges in selection of antifoggants. This is due to the presence of at least two different silver salt compositions in the same emulsion grains. Thus in the case of Ag(Br, I) hosts that have AgCl-containing epitaxy deposited on them, it is not immediately evident whether addenda should be selected that are appropriate to the Ag(Br, I) host or to the AgCl-containing epitaxy. It is further complicated by the fact that the host and epitaxy will likely have different exposed crystal lattice planes, and what adsorbs to host planes may not adsorb to those of the epitaxy, or an addendum that stablizes one surface may destabilize the other. Moreover, there is a strong entropic driving force for the Ag(Br, I) host and AgCl regions to recrystallize to form a single uniform composition (C. R. Berry in The Theory of the Photographic Process, 4th Ed., T. H. James, Ed., New York: Macmillan Publishing Co., Inc., (1977), p 94f). Finally, if the Ag(Br, I) host is ultrathin, there is the additional strong tendency for Ostwald ripening to occur due to the high surface energy resulting from their large surface area/volume ratio (C. R. Berry, loc cit, p 93). For these reasons, choice of antifogging addenda for epitaxially sensitized tabular grain emulsions is not at all obvious.

Finally it is important to note that while discrimination between exposed and nonexposed areas is the most basic requirement of a photographic film or paper, it is by no means the only one. In particular, it is highly desirable to achieve stabilization against fog without degradation of sensitivity, developability, or image structure. The most preferable method would minimize fog, increase photographic speed, and decrease granularity.

Problem to be Solved by the Invention

There is a continuing need for methods of improving the speed/fog characteristics of epitaxially sensitized tabular grain emulsions.

SUMMARY OF THE INVENTION

The invention relates to a radiation-sensitive silver halide emulsion comprising silver halide grains including tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and a spectral sensitizing dye adsorbed to the surfaces of the tabular grains, wherein the surface chemical sensitization sites include at least one silver salt epitaxially located on said tabular grains and further comprising at least one sulfodihydroxy aryl compound represented by the Formulas I or II

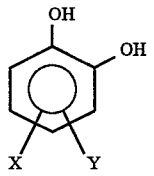

(Formula I)

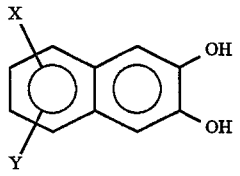

(Formula II)

wherein

X and Y represent an $SO_3$ group or a hydrogen with at least one of X and Y being a sulfo group.

Advantageous Effect of the Invention

These antifoggants in epitaxially sensitized emulsions offer remarkably high discrimination between exposed and unexposed areas of photographic elements containing such emulsions. They also offer improvements in image structure. Improved discrimination and decreased granularity are of obvious value to photographers.

DETAILED DESCRIPTION OF THE INVENTION

Recently, Antoniades et al U.S. Pat. No. 5,250,403 disclosed tabular grain emulsions that represent what were, prior to the present invention, in many ways the best available emulsions for recording exposures in color photographic, elements, particularly in the minus blue (red and/or green) portion of the spectrum. Antoniades et al disclosed tabular grain emulsions in which tabular grains having {111} major faces account for greater than 97 percent of total grain projected area. The tabular grains have an equivalent circular diameter (ECD) of at least 0.7 μm, and a mean thickness of less than 0.07 μm. Tabular grain emulsions with mean thicknesses of less than 0.07 μm are herein referred to as "ultrathin" tabular grain emulsions. They are suited for use in color photographic elements, particularly in minus blue recording emulsion layers, because of their efficient utilization of silver, attractive speed-granularity relationships, and high levels of image sharpness, both in the emulsion layer and in underlying emulsion layers.

An early variation on the teachings of Kofron et al U.S. Pat. No. 4,439,520 was provided by Maskasky U.S. Pat. No. 4,435,501, hereinafter referred to as Maskasky I. Maskasky I recognized that a site director, such as iodide ion, an aminoazaindene, or a selected spectral sensitizing dye, adsorbed to the surfaces of host tabular grains was capable of directing silver salt epitaxy to selected sites, typically the edges and/or corners, of the host grains. Depending upon the composition and site of the silver salt epitaxy, significant increases in speed were observed.

A characteristic of ultrathin tabular grain emulsions that sets them apart from other tabular grain emulsions is that they do not exhibit reflection maxima within the visible spectrum, as is recognized to be characteristic of tabular grains having thicknesses in the 0.18 to 0.08 μm range, as taught by Buhr et al, *Research Disclosure*, Vol. 253, Item 25330, May 1985. *Research Disclosure* is published by Kenneth Mason Publications, Ltd., Dudley House, 12 North St., Emsworth, Hampshire P010 7DQ, England. In multilayer photographic elements overlying emulsion layers with mean tabular grain thicknesses in the 0.18 to 0.08 μm range require care in selection, since their reflection properties differ widely within the visible spectrum. The choice of ultrathin tabular grain emulsions in building multilayer photographic elements eliminates spectral reflectance dictated choices of different mean grain thicknesses in the various emulsion layers overlying other emulsion layers. Hence, the use of ultrathin tabular grain emulsion not only allows improvements in photographic performance, it also offers the advantage of simplifying the construction of multilayer photographic elements.

The resulting emulsions of the invention show improvements which are unexpected.

Specifically, increases in sensitivity imparted to ultrathin tabular grain emulsions by silver salt epitaxy have been observed to be larger than were expected based on the observations of Maskasky I employing thicker tabular host grains.

Additionally, the emulsions of the invention exhibit lower than expected fog.

At the same time, the anticipated unacceptable reductions in image sharpness, which epitaxial deposits were expected to cause and which were investigated in terms of specularity measurements, simply did not materialize, even when the quantities of silver salt epitaxy were increased well above the preferred maximum levels taught by Maskasky I.

Still another advantage is based on the observation of reduced unwanted wavelength absorption as compared to relatively thicker tabular grain emulsions similarly sensitized. A higher percentage of total light absorption was confined to the spectral region in which the spectral sensitizing dye or dyes exhibited absorption maxima. For minus blue sensitized ultrathin tabular grain emulsions native blue absorption was also reduced.

Finally, the emulsions investigated have demonstrated an unexpected robustness. It has been demonstrated that, when levels of spectral sensitizing dye are varied, as can occur during manufacturing operations, the silver salt epitaxially sensitized ultrathin tabular grain emulsions of the invention exhibit less variance in sensitivity and fog than comparable ultrathin tabular grain emulsions that employ only sulfur and gold sensitizers.

The invention is directed to an improvement in spectrally sensitized photographic emulsions. The emulsions are specifically contemplated for incorporation in camera speed color photographic films.

The emulsions of the invention can be realized by chemically and spectrally sensitizing any conventional ultrathin tabular grain emulsion in which the tabular grains (a) have {111} major faces;

(b) contain greater than 70 mole percent bromide, based on silver, (c) account for greater than 90 percent of total grain projected area;

(d) exhibit an average ECD of at least 0.7 μm; and (e) exhibit an average thickness of less than 0.07 μm.

Although criteria (a) through (e) are too stringent to be satisfied by the vast majority of known tabular grain emulsions, a few published precipitation techniques are capable of producing emulsions satisfying these criteria. Antoniades et al, U.S. Pat. No. 5,250,403 here incorporated by reference, demonstrates preferred silver iodobromide emulsions satisfying these criteria. Zola and Bryant published European patent application 0 362 699 A3, also discloses silver iodobromide emulsions satisfying these criteria.

In referring to grains and emulsions containing more than one halide, the halides are named in their order of ascending concentration.

For camera speed films it is generally preferred that the tabular grains contain at least 0.25 (preferably at least 1.0) mole percent iodide, based on silver. Although the saturation level of iodide in a silver bromide crystal lattice is generally cited as about 40 mole percent and is a commonly cited limit for iodide incorporation, for photographic applications iodide concentrations seldom exceed 20 mole percent and are typically in the range of from about 1 to 12 mole percent.

As is generally well understood in the art, precipitation techniques, including those of Antoniades et al and Zola and Bryant, that produce silver iodobromide tabular rain emulsions can be modified to produce silver bromide tabular grain emulsions of equal or lesser mean grain thicknesses simply by omitting iodide addition. This is specifically taught by Kofron et al.

It is possible to include minor amounts of chloride ion in the ultrathin tabular Grains. As disclosed by Delton U.S. Pat. No. 5,372,927 and here incorporated by reference, and Delton U.S. Ser. No. 238,119, filed May 4, 1994, titled CHLORIDE CONTAINING HIGH BROMIDE ULTRATHIN TABULAR GRAIN EMULSIONS, both commonly assigned, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (°C.) boundaries of Curve A (preferably within the boundaries of Curve B) shown by Delton, corresponding to Curves A and B of Piggin et al U.S. Pat. Nos. 5,061,609 and 5,061,616, the disclosures of which are here incorporated by reference. Under these conditions of precipitation the presence of chloride ion actually contributes to reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

For reasons discussed below in connection with silver salt epitaxy the ultrathin tabular grains accounting for at least 90 percent of total grain projected area contain at least 70 mole percent bromide, based on silver. These ultrathin tabular grains include silver bromide, silver iodobromide, silver chlorobromide, silver iodochlorobromide and silver chloroiodobromide grains. When the ultrathin tabular grains include iodide, the iodide can be uniformly distributed within the tabular grains. To obtain a further improvement in speed-granularity relationships it is preferred that the iodide distribution satisfy the teachings of Solberg et al U.S. Pat. No. 4,433,048, the disclosure of which is here incorporated by reference. The application of the iodide profiles of Solberg et al to ultrathin tabular grain emulsions is the specific subject matter of Daubendiek II, cited above. All references to the composition of the ultrathin tabular grains exclude the silver salt epitaxy.

The ultrathin tabular grains produced by the teachings of Antoniades et al, Zola and Bryant and Delton all have {111} major faces. Such tabular grains typically have triangular or hexagonal major faces. The tabular structure of the grains is attributed to the inclusion of parallel twin planes.

The tabular grains of the emulsions of the invention account for greater than 90 percent of total grain projected area. Ultrathin tabular grain emulsions in which the tabular grains account for greater than 97 percent of total grain projected area can be produced by the preparation procedures taught by Antoniades et al and are preferred. Antoniades et al reports emulsions in which substantially all (e.g., up to 99.8%) of total grain projected area is accounted for by tabular grains. Similarly, Delton reports that "substantially all" of the grains precipitated in forming the ultrathin tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains accounting for greater than 90 percent of total grain projected area exhibit an average ECD (equivalent circular diameter) of at least 0.7 μm. The advantage to be realized by maintaining the average ECD of at least 0.7 μm is demonstrated in Tables III and IV of Antoniades et al. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the ultrathin tabular grain emulsions of the invention the tabular grains accounting for greater than 90 percent of total grain projected area exhibit a mean thickness of less than 0.07 μm. At a mean grain thickness of 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by Antoniades et al these emulsions could be grown to average ECD's of at least 0.7 μm without appreciable thickening, e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of Antoniades et al, Kofron et. al suggests a practical minimum tabular grain thickness about 0.01 μm.

Preferred ultrathin tabular grain emulsions are those in which grain to grain variance is held to low levels. Antoniades et al reports ultrathin tabular grain emulsions in which greater than 90 percent of the tabular grains have hexagonal major faces. Antoniades also reports ultrathin tabular grain emulsions exhibiting a coefficient of variation (COV) based on ECD of less than 25 percent and even less than 20 percent.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger ECD grains in the ultrathin tabular grain emulsions of the invention can produce a significant increase in emulsion granularity. Antoniades et al preferred low COV (Coefficient of Variation is the standard deviation divided by the mean and multiplied by 100) emulsions, since placing restrictions on COV necessarily draws the tabular grain ECD's present closer to the mean.

It is a recognition of this invention that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to modify the ultrathin tabular grain precipitation procedures taught by Antoniades et al to decrease selectively the size-frequency distribution of the ultrathin tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been discovered that disproportionate size range reductions in the size-frequency distributions of ultrathin tabular grains having greater than mean ECD's (hereinafter referred to as the $>ECD_{av}$ grains) can be realized by modifying the procedure for precipitation of the ultrathin tabular grain emulsions in the following manner: Ultrathin tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed. Maskasky U.S. Pat. No. 4,713,320 (hereinafter referred to as Maskasky II), here incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky II employ reduce methionine below detectable limits. Examples of agents that have been employed for oxidizing the methionine in gelatino-peptizers include NaOCl, chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfate of one of the following formulae:

$$R\text{-}SO_2S\text{-}M \quad (I)$$

$$R\text{-}SO_2S\text{-}R^1 \quad (II)$$

$$R\text{-}SO_2S\text{-}Lm\text{-}SSO_2\text{-}R^2 \quad (III)$$

where R, $R^1$ and $R^2$ are either the same or different and represent an aliphatic group, an aromatic group, or a heterocyclic group, M represents a cation, L represents a divalent linking group, and m is 0 or 1, wherein R, $R^1$, $R^2$ and L combine to form a ring. Gelatino-peptizers include gelatin, e.g., alkali-treated gelatin (cattle, bone or hide gelatin) or acid-treated gelatin (pigskin gelatin) and gelatin derivatives, e.g., acetylated or phthalated gelatin.

Although not essential to the practice of the invention, improvements in photographic performance compatible with the advantages elsewhere described can be realized by incorporating a dopant in the ultrathin tabular grains. As employed herein the term "dopant" refers to a material other than a silver or halide ion contained within the face centered cubic crystal lattice structure of the silver halide forming the ultrathin tabular grains. Although the introduction of dopants can contribute to the thickening of ultrathin tabular grains during their precipitation when introduced in high concentrations and/or before, during or immediately following grain nucleation, ultrathin tabular grains can be formed with dopants present during grain growth, wherein dopant introductions are delayed until after grain nucleation, introduced in prorated amounts early in grain growth and preferably continued into or undertaken entirely during the latter stage of ultrathin tabular grain growth. It has been also recognized from the teachings of Olm et al, cited above, that these same dopants can be introduced with the silver salt to be epitaxially deposited on the ultrathin tabular grains while entirely avoiding any risk of thickening the ultrathin tabular grains.

Any conventional dopant known to be useful in a silver halide face centered cubic crystal lattice structure can be employed. Photographically useful dopants selected from a wide range of periods and groups within the Periodic Table of Elements have been reported. As employed herein, references to periods and groups are based on the Periodic Table of Elements as adopted by the American Chemical Society and published in the *Chemical and Engineering News*, Feb. 4, 1985, p. 26. Conventional dopants include ions from periods 3 to 7 (most commonly 4 to 6) of the Periodic Table of Elements, such as Fe, Co, Ni, Ru, Rh, Pd, Re, Os, Ir, Pt, Mg, Al, Ca, Sc, Ti, V, Cr, Mn, Cu, Zn, Ga, Ge, As, Se, Sr, Y, Mo, Zr, Nb, Cd, In, Sn, Sb, Ba, La, W, Au, Hg, Tl, Pb, Bi, Ce and U. The dopants can be employed (a) to increase the sensitivity, (b) to reduce high or low intensity reciprocity failure, (c) to increase, decrease or reduce the variation of contrast, (d) to reduce pressure sensitivity, (e) to decrease dye desensitization, (f) to increase stability (including reducing thermal instability), (g) to reduce minimum density, and/or (h) to increase maximum density. For some uses any polyvalent metal ion is effective. The following are illustrative of conventional dopants capable of producing one or more of the effects noted above when incorporated in the silver halide epitaxy: B. H. Carroll, "Iridium Sensitization: A Literature Review", *Photographic Science and Engineering*, Vol. 24, No. 6, Nov./Dec. 1980, pp. 265–267; Hochstetter U.S. Pat. No. 1,951,933; De Witt U.S. Pat. No. 2,628,167; Spence et al U.S. Pat. No. 3,687,676 and Gilman et al U.S. Pat. No. 3,761,267; Ohkubo et al U.S. Pat. No. 3,890,154; Iwaosa et al U.S. Pat. No. 3,901,711; Yamasue et al U.S. Pat. No. 3,901,713; Habu et al U.S. Pat. No. 4,173,483; Atwell U.S. Pat. No. 4,269,927; Weyde U.S. Pat. No. 4,413,055; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Pat. No. 4,835,093; Leubner et al U.S. Pat. No. 4,902,611; Inoue et al U.S. Pat. No. 4,981,780; Kim U.S. Pat. No. 4,997,751; Shiba et al U.S. Pat. No. 5,057,402; Maekawa et al U.S. Pat. No. 5,134,060; Kawai et al U.S. Pat. No. 5,153,110; Johnson et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Bell U.S. Pat. Nos. 5,252,451 and 5,252,530; Komorita et al EPO 0 244 184; Miyoshi et al EPO 0 488 737 and 0 488 601; Ihama et a EPO 0 368 304; Tashiro EPO 0 405 938; Murakami et al EPO 0 509 674 and 0 563 946 and Japanese Patent Application Hei-2[1990]-249588 and Budz WO 93/02390.

When dopant metals are present during precipitation in the form of coordination complexes, particularly tetra- and hexa-coordination complexes, both the metal ion and he coordination ligands can be occluded within the grains. Coordination ligands, such as halo, aquo, cyano, cyanate, fulminate, thiocyanate, selenocyanate, tellurocyanate, nitrosyl, thionitrosyl, azide, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781 and 5,037,732, Marchetti et al U.S. Pat. No. 4,937,180, Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320. Olm et al U.S. Pat. No. 5,360,712 discloses hexacoordination complexes containing organic ligands while Bigelow U.S. Pat. No. 4,092,171 discloses organic ligands in Pt and Pd tetra-coordination complexes.

It is specifically contemplated to incorporate in the ultrathin tabular grains a dopant to reduce reciprocity failure. Iridium is a preferred dopant for decreasing reciprocity failure. The teachings of Carroll, Iwaosa et al, Habu et al, Grzeskowiak et al, Kim, Maekawa et al, Johnson et al, Asami, Yoshida et al, Bell, Miyoshi et al, Tashiro and Murakami et al EPO 0 509 674, each cited above, are here incorporated by reference. These teachings can be applied to the emulsions of the invention merely by incorporating the dopant during silver halide precipitation.

In another specifically preferred form of the invention it is contemplated to incorporate in the face centered cubic crystal lattice of the ultrathin tabular grains a dopant capable of increasing photographic speed by forming shallow electron traps. When a photon is absorbed by a silver halide grain, an electron (hereinafter referred to as a photoelectron) is promoted from the valence band of the silver halide crystal lattice to its conduction band, creating a hole (hereinafter referred to as a photohole) in the valence band. To create a latent image site within the grain, a plurality of photoelectrons produced in a single imagewise exposure must reduce several silver ions in the crystal lattice to form a small cluster of $Ag^{o}$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope the silver halide to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^{+}$) in the crystal lattice structure. The substitution of a divalent cation, for example, for the monovalent $Ag^{+}$cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and *Excitonic Processes in Solids* by M. Ueta, H. Kansaki, K. Kobayshi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled, e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 μmetal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+}3$ and $In^{+}3$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. jorgensen, 1962, Pergamon Press; London. From these references the following order of metal ions in the spectrochemical series is apparent:

$$I^- < Br^- < S^{-2} < SCN^- < Cl^- < NO_3^- < F^- < QH < ox^{-2} < H_2O < NCS^- < CH_3CN^- < NH_3 < en < dipy. < phen < NO_2^- < phosph << CN^- < CO.$$

The abbreviations used are as follows: en=ethylenediamine, ox=oxalate, dipy=dipyridine, phen=o-phenathroline, and phosph=4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $CN^-$and CO are especially preferred. Other preferred ligands are thiocyanate ($NCS^-$), selenocyanate ($NCSe^-$), cyanate ($NCO^-$), tellurocyanate ($NCTe^-$) and azide ($N_3^-$).

Just as the spectrochemical series can be applied to ligands of coordination complexes, it can also be applied to the metal ions. The following spectrochemical series of metal ions is reported in Absorption Spectra and Chemical Bonding by C. K. Jorgensen, 1962, Pergamon Press, London:

$$Mn^{+2} < Ni^{+2} < Co^{+2} < Fe^{+2} < Cr^{+3} \approx V^{+3} < Co^{+3} < Mn^{+4} < Mo^{+3} < Rh^{+3} \approx Ru^{+3} < Pd^{+4} < Ir^{+3} < Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be-identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, Fe(II) $(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagneticresonance (EPR) spectroscopy. This analytical technique is widely used as an analytical method and s described in *Electron Spin Resonance: A Comprehensive Treatise on Experimental Techniques*, 2nd Ed., by Charles P. Poole, Jr. (1983) published by John Wiley & Sons, Inc., New York.

Photoelectrons in shallow electron traps give rise to an EPR signal very similar to that observed for photelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symonsin the journal *Physica Status Solidi* (b), Vol. 152 (1989), pp. 583–592, in a AgCl crystal the g factor of the electron EPR signal is 1.88±0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN6)^{4-}$in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20, 40 and 60° K. respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are preferred coordination complexes for use in the practice of this invention. They contain a metal ion and six ligands that displace a silver ion and six adjacent halide ions in the crystal lattice. One or two of the coordination sites can be occupied by neutral ligands, such as carbonyl, aquo or amine ligands, but the remainder of the ligands must be anionic to facilitate efficient incorporation of the coordination complex in the crystal lattice structure. Illustrations of specifically contemplated hexacoordination complexes for inclusion in the protrusions are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[1990]-249588, the disclosures of which are here incorporated by reference. Useful neutral and anionic organic ligands for hexacoordination complexes are disclosed by Olm et al U.S. Pat. No. 5,360,712, the disclosure of which is here incorporated by reference. Careful scientific investigations have revealed Group VIII hexahalo coordination complexes to create deep (desensitizing) electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980).

In a specific, preferred form it is contemplated to employ as a dopant a hexacoordination complex satisfying the formula:

$$[ML_6]n \qquad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally, at least 4) of the ligands is more electronegative than any halide ligand; and n is -2, -3 or -4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |

It is additionally contemplated to employ oligomeric coordination complexes to increased speed, as taught by Evans et al U.S. Pat. No. 5,024,931, the disclosure of which is here incorporated by reference.

The dopants are effective in conventional concentrations, where concentrations are based on the total silver, including both the silver in the tabular grains and the silver in the protrusions. Generally shallow electron trap forming dopants are contemplated to be incorporated in concentrations of at least $1\times10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole. It is, of course, possible to distribute the dopant so that a portion of it is incorporated in the ultrathin tabular grains and the remainder is incorporated in the silver halide protrusions.

Subject to modifications specifically described below, preferred techniques for chemical and spectral sensitization are those described by Maskasky I, cited above and here incorporated by reference. Maskasky I reports improvements in sensitization by epitaxially depositing silver salt at selected sites on the surfaces of the host tabular grains. Maskasky I attributes the speed increases observed to restricting silver salt epitaxy deposition to a small fraction of the host tabular grain surface area. Specifically, Maskasky I teaches to restrict silver salt epitaxy to less than 25 percent, preferably less than 10 percent, and optimally less than 5 percent of the host grain surface area. Although the observations of this invention in general corroborate increasing photographic sensitivity as the percentage of host tabular grain surface area occupied by epitaxy is restricted, silver salt epitaxy has been found to be advantageous even when its location on the host tabular grains is not significantly restricted. This is corroborated by the teachings of Chen et al published European patent application 0 498 302, here incorporated by reference, which discloses high solubility silver halide protrusions on silver halide host tabular grains occupying up to 100 percent of the host tabular grain surface area. Therefore, in the practice of this invention restriction of the percentage of host tabular grain surface area occupied by silver salt epitaxy is viewed as a preference rather than a requirement of the invention. However, it is preferred that the silver salt epitaxy occupy less than 50 percent of the host tabular grain surface area.

Like Maskasky I, nominal amounts of silver salt epitaxy (as low as 0.05 mole percent, based on total silver, where total silver includes that in the host and epitaxy) are effective in the practice of the invention. Because of the increased host tabular grain surface area coverages by silver salt epitaxy discussed above and the lower amounts of silver in ultrathin tabular grains, an even higher percentage of the total silver can be present in the silver salt epitaxy. However, in the absence of any clear advantage to be gained by increasing the proportion of silver salt epitaxy, it is preferred that the silver salt epitaxy be limited to 50 percent of total silver. Generally silver salt epitaxy concentrations of from 0.3 to 25 mole percent are preferred, with concentrations of from about 0.5 to 15 mole percent being generally optimum for sensitization.

Maskasky I teaches various techniques for restricting the surface area coverage of the host tabular grains by silver salt epitaxy that can be applied in forming the emulsions of this invention. Maskasky I teaches employing spectral sensitizing dyes that are in their aggregated form of adsorption to the tabular grain surfaces capable of direct silver salt epitaxy to the edges or corners of the tabular grains. Cyanine dyes that are adsorbed to host ultrathin tabular grain surfaces in their J-aggregated form constitute a specifically preferred class of site directors. Maskasky I also teaches to employ non-dye adsorbed site directors, such as aminoazaindenes (e.g., adenine) to direct epitaxy to the edges or corners of the tabular grains. In still another form Maskasky I relies on overall iodide levels within the host tabular grains of at least 8 mole percent to direct epitaxy to the edges or corners of the tabular grains. In yet another form Maskasky I adsorbs low levels of iodide to the surfaces of the host tabular grains to direct epitaxy to the edges and/or corners of the grains. The above site directing techniques are mutually compatible and are in specifically preferred forms of the invention employed in combination. For example, iodide in the host grains, even though it does not reach the 8 mole percent level that will permit it alone to direct epitaxy to the edges or corners of the host tabular grains can nevertheless work with adsorbed surface site director(s) (e.g., spectral sensitizing dye and/or adsorbed iodide) in siting the epitaxy.

To avoid structural degradation of the ultrathin tabular grains it is generally preferred that the silver salt epitaxy be of a composition that exhibits a higher overall solubility than the overall solubility of the silver halide or halides forming the ultrathin host tabular grains. The overall solubility of mixed silver halides is the mole fraction weighted average of the solubilities of the individual silver halides. This is one reason for requiring at least 70 mole percent bromide, based on silver, in the ultrathin tabular grains. Because of the large differences between the solubilities of the individual silver halides, the iodide content of the host tabular grains will in the overwhelming majority of instances be equal to or greater than that of the silver salt epitaxy. Silver chloride is a specifically preferred silver salt for epitaxial deposition onto the host ultrathin tabular grains. Silver chloride, like silver bromide, forms a face centered cubic lattice structure, thereby facilitating epitaxial deposition. There is, however, a difference in the spacing of the lattices formed by the two halides, and it is this difference that creates the epitaxial junction believed responsible for at least a major contribution to increased photographic sensitivity. To preserve the structural integrity of the ultrathin tabular grains epitaxial deposition is preferably conducted under conditions that restrain solubilization of the halide forming the ultrathin tabular grains. For example, the minimum solubility of silver bromide at 60° C. occurs between a pBr of between 3 and 5, with pBr values in the range of from about 2.5 to 6.5 offering low silver bromide solubilities. Nevertheless, it is contemplated that to a limited degree, the halide in the silver salt epitaxy will be derived from the host ultrathin tabular grains. Thus, silver chloride epitaxy containing minor amounts of bromide and, in some instances, iodide is specifically contemplated.

Silver bromide epitaxy on silver chlorobromide host tabular grains has been demonstrated by Maskasky I as an example of epitaxially depositing a less soluble silver halide on a more soluble host and is, therefore, within the contemplation of the invention, although not a preferred arrangement.

Maskasky I discloses the epitaxial deposition of silver thiocyanate on host tabular Grains. Silver thiocyanate epitaxy, like silver chloride, exhibits a significantly higher solubility than silver bromide, with or without minor amounts of chloride and/or iodide. An advantage of silver thiocyanate is that no separate site director is required to achieve deposition selectively at or near the edges and/or corners of the host ultrathin tabular grains. Maskasky U.S. Pat. No. 4,471,050, incorporated by reference and hereinafter referred to as Maskasky III, includes silver thiocyanate epitaxy among various nonisomorphic silver salts that can be epitaxially deposited onto face centered cubic crystal lattice host silver halide grains. Other examples of self-directing nonisomorphic silver salts available for use as epitaxial silver salts in the practice of the invention include β phase silver iodide, γ phase silver iodide, silver phosphates (including meta- and pyrophosphates) and silver carbonate.

It is generally accepted that selective site deposition of silver salt epitaxy onto host tabular grains improves sensitivity by reducing sensitization site competition for conduction band electrons released by photon absorption on imagewise exposure. Thus, epitaxy over a limited portion of the major faces of the ultrathin tabular grains is more efficient than that overlying all or most of the major faces, still better is epitaxy that is substantially confined to the edges of the host ultrathin tabular grains, with limited coverage of their major faces, and still more efficient is epitaxy that is confined at or near the corners or other discrete sites of the tabular Grains. The spacing of the corners of the major faces of the host ultrathin tabular Grains in itself reduces photoelectron competition sufficiently to allow near maximum sensitivities to be realized. Maskasky I teaches that slowing the rate of epitaxial deposition can reduce the number of epitaxial deposition sites on a host tabular grain. Yamashita et al U.S. Pat. No. 5,011,767, here incorporated by reference, carries this further and suggests specific spectral sensitizing dyes and conditions for producing a single epitaxial junction per host grain.

Silver salt epitaxy can by itself increase photographic speeds to levels comparable to those produced by substantially optimum chemical sensitization with sulfur and/or gold. Additional increases in photographic speed can be realized when the tabular grains with the silver salt epitaxy deposited thereon are additionally chemically sensitized with conventional middle chalcogen (i.e., sulfur, selenium or tellurium) sensitizers or noble metal (e.g., gold) sensitizers. A general summary of these conventional approaches to chemical sensitization that can be applied to silver salt epitaxy sensitizations are contained in *Research Disclosure* Dec. 1989, Item 308119, Section III. Chemical sensitization. Kofron et al illustrates the application of these sensitizations to tabular grain emulsions.

A specifically preferred approach to silver salt epitaxy sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen ripeners are tetrasubstituted middle chalcogen ureas of the type disclosed by Herz et al U.S. Pat. Nos. 4,749,646 and 4,810,626.

Certain middle chalcogen thioureas can act as sensitizers, as disclosed by Burgmaier et al U.S. Pat. No. 4,810,626, the disclosures of which are here incorporated by reference. Preferred compounds include those represented by the formula:

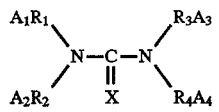

(V)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold (I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VI)}$$

wherein

L is a mesoionic compound;

X is an anion; and $L^1$ is a Lewis acid donor.

Kofron et al discloses advantages for "dye in the finish" sensitizations, which are those that introduce the spectral sensitizing dye into the emulsion prior to the heating step (finish) that results in chemical sensitization. Dye in the finish sensitizations are particularly advantageous in the practice of the present invention where spectral sensitizing dye is adsorbed to the surfaces of the tabular grains to act as a site director for silver salt epitaxial deposition. Maskasky I teaches the use of aggregating spectral sensitizing dyes, particularly green and red absorbing cyanine dyes, as site directors. These dyes are present in the emulsion prior to the chemical sensitizing finishing step. When the spectral sensitizing dye present in the finish is not relied upon as a site director for the silver salt epitaxy, a much broader range of spectral sensitizing dyes is available. The spectral sensitizing dyes disclosed by Kofron et al, particularly the blue spectral sensitizing dyes shown by structure and their longer methine chain analogs that exhibit absorption maxima in the green and red portions of the spectrum, are particularly preferred for incorporation in the ultrathin tabular grain emulsions of the invention. A more general summary of useful spectral sensitizing dyes is provided by *Research Disclosure*, Dec. 1989, Item 308119, Section IV. Spectral sensitization and desensitization, A. Spectral sensitizing dyes.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an ultrathin tabular grain according to the invention after chemical sensitization has been completed.

Since ultrathin tabular grain emulsions exhibit significantly smaller mean grain volumes than thicker tabular grains of the same average ECD, native silver halide sensitivity in the blue region of the spectrum is lower for ultrathin tabular grains. Hence blue spectral sensitizing dyes improve photographic speed significantly, even when iodide levels in the ultrathin tabular grains are relatively high. At exposure wavelengths that are bathochromically shifted in relation to native silver halide absorption, ultrathin tabular grains depend almost exclusively upon the spectral sensitizing dye or dyes for photon capture. Hence, spectral sensitizing dyes with light absorption maxima at wavelengths longer than 430 nm (encompassing longer wavelength blue, green, red and/or infrared absorption maxima) adsorbed to the grain surfaces of the invention emulsions produce very large speed increases. This is in part attributable to relatively lower mean grain volumes and in part to the relatively higher mean grain surface areas available for spectral sensitizing dye adsorption.

The mercaptotetrazole compounds suitable for this invention are those having the following Formula III:

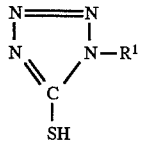

Formula III where $R^1$ is an aliphatic or aromatic radical containing up to 20 carbon atoms. Alkyl or aryl radicals comprising R may be unsubstituted or substituted. Suitable substituents include, for example, alkoxy, phenoxy, halogen, cyano, nitro, amino, substituted amino, sulfo, sulfamyl, substituted sulfamyl, sulfonylphenyl, sulfonylalkyl, fluorosulfonyl, sulfonamidophenyl, sulfonamidoalkyl, carboxy, carboxylate, ureido carbamyl, carbamylphenyl, carbamylalkyl, carbonylalkyl, and carbonylphenyl.

The following are examples of the compounds having Formula III, but the present invention is not limited by the examples. The Formula S-5 compound is the preferred mercaptotetrazole.

Exemplified Compounds of Formula III

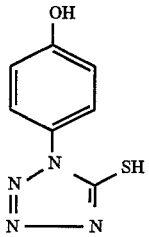

(S-1)

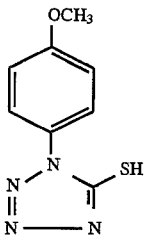

(S-2)

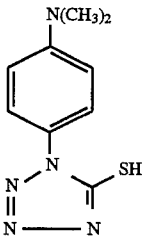

(S-3)

-continued

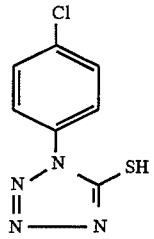

(S-4)

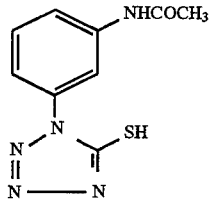

(S-5)

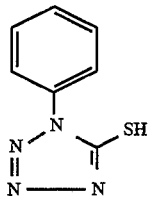

(S-6)

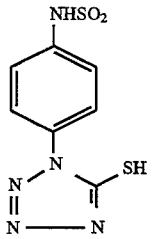

(S-7)

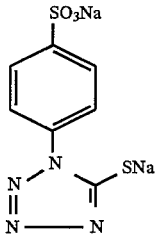

(S-8)

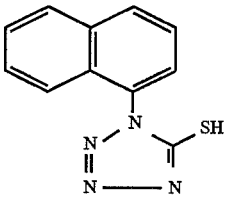

(S-9)

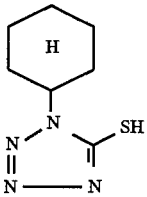

(S-10)

Further examples of mercapto compounds useful in the practice of this invention are 1-(3-methoxy-phenyl)-5-mercaptotetrazole, 1-(3-ureidophenyl)-5-mercaptotetrazole, 1-(3-N-carboxymethyl)-ureidophenyl)-5-mercaptotetrazole, 1-(3-N-ethyl oxalamido)phenyl)-5-mercaptotetrazole, 1-(4-ureidophenyl)-5-mercaptotetrazole, 1-(4-acetamidophenyl)-

5-mercaptotetrazole, and 1-(4-carboxyphenyl)-5-mercaptotetrazole.

The sulfodihydroxy aryl compounds of this invention are represented by Formulas I or II:

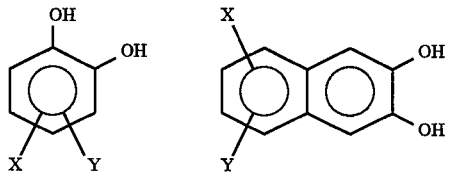

(Formula I) (Formula II)

In the above formula, X and Y represent a sulfo ($SO_3$) group or a hydrogen, with at least one of X and Y being a sulfo group. The sulfo group is generally in a form of water soluble salts comprising alkali metals such as sodium, potassium, and ammonium. Examples of preferred compounds include:

Compound I-1: 3,5-disulfo-catechol disodium salt or 4,5-dihydroxy benzene-1,3-disulfonic acid, disodium salt Compound I-2: 4-sulfocatechol ammonium salt Compound II-1: 2,3-dihydroxy-7-sulfonaphthalene sodium salt Compound II-2: 2,3-dihydroxy-6,7-disulfonaphthalene potassium salt The term "catechol" is equivalent to such commonly used terms as "pyrocatechol", "1,2-benzenediol", and "1,2-dihydroxybenzene".

The sulfodihydroxy aryl compounds of this invention can be prepared by various methods known to those skilled in the art such as those disclosed by Fukeyama et al in Japanese Pat. No. 4327 ('52) and referenced in The Merck Index, p. 1219, Ninth Edition, 1976, by Merck & Co., Inc., NJ. The sulfodehydroxy compounds may be adsorbed onto the grains during forming or sensitizing, or after sensitizing.

A method of the invention may be performed utilizing any suitable sensitizing temperature. Typical temperatures are between about 40° and 80° C. A preferred temperature for epitaxial sensitization with DCT has been found to be between about 40° and about 60° C. for best sensitization and low time of heat digestion (sensitization) times. The sensitization time may be any suitable amount. Typical sensitization times during which the material is at the highest temperature of the cycle is between about 1 and about 30 minutes. A preferred time is between about 5 and 20 minutes for best sensitization and lower cost of sensitization, as the cycle time is reasonably short.

The optimal amount of each of the antifoggants depends on the desired final result and emulsion variables, such as composition of host and epitaxy, choice of sensitizing dye, and level and type of chemical sensitizers. In general a suitable concentration of mercaptotetrazole will range from about 0.0000001 to about 0.010 moles/mole Ag with the preferred range being about 0.000001 to about 0.0010 moles/mole Ag. A suitable concentration of the sulfodihydroxy aryl compound will range between about 0.00001 and about 0.5 moles/mole Ag, with the preferred range being about 0.0001 to about 0.10 moles/mole Ag.

Aside from the features of spectral sensitized, silver salt epitaxy sensitized ultrathin tabular grain emulsions described above, the emulsions of this invention and their preparation can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Vol. 308, December 1989, Item 308119, Section I, Paragraph I, the disclosure of which is here incorporated by reference.

The emulsions once formed can be further prepared for photographic use by any convenient conventional technique. Additional conventional features are illustrated by *Research Disclosure* Item 308119, cited above, Section II, Emulsion washing; Section VI, Antifoggants and stabilizers; Section VII, Color materials; Section VIII, Absorbing and scattering materials; Section IX, Vehicles and vehicle extenders; X, Hardeners; XI, Coating aids; and XII, Plasticizers and lubricants; the disclosure of which is here incorporated by reference. The features of VII—XII can alternatively be provided in other photographic element layers.

The novel epitaxial silver salt sensitized ultrathin tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

This invention may be utilized in a photographic element containing at least two superimposed radiation sensitive silver halide emulsion layers coated on a conventional photographic support of any convenient type. Exemplary photographic supports are summarized by *Research Disclosure*, Item 308119, cited above, Section XVII, here incorporated by reference. The emulsion layer coated nearer the support surface is spectrally sensitized to produce a photographic record when the photographic element is exposed to specular light within the minus blue portion of the visible spectrum. The term "minus blue" is employed in its art recognized sense to encompass the green and red portions of the visible spectrum, i.e., from 500 to 700 nm. The term "specular light" is employed in its art recognized usage to indicate the type of spatially oriented light supplied by a camera lens to a film surface in its focal plane, i.e., light that is for all practical purposes unscattered.

The second of the two silver halide emulsion layers is coated over the first silver halide emulsion layer. In this arrangement the second emulsion layer is called upon to perform two entirely different photographic functions. The first of these functions is to absorb at least a portion of the light wavelengths it is intended to record. The second emulsion layer can record light in any spectral region ranging from the near ultraviolet (≧300 nm) through the near infrared (≦1500 nm). In most applications both the first and second emulsion layers record images within the visible spectrum. The second emulsion layer in most applications records blue or minus blue light and usually, but not necessarily, records light of a shorter wavelength than the first emulsion layer. Regardless of the wavelength of recording contemplated, the ability of the second emulsion layer to provide a favorable balance of photographic speed and image structure (i.e., granularity and sharpness) is important to satisfying the first function.

The second distinct function which the second emulsion layer must perform is the transmission of minus blue light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

How the overlying (second) emulsion layer can cause unsharpness in the underlying (first) emulsion layer is explained in detail by Antoniades et al, incorporated by reference, and hence does not require a repeated explanation.

It has been discovered that a favorable combination of photographic sensitivity and image structure (e.g., granularity and sharpness) are realized when silver salt epitaxy sensitized ultrathin tabular grain emulsions satisfying the requirements of the invention are employed to form at least the second, overlying emulsion layer. It is surprising that the presence of silver salt epitaxy on the ultrathin tabular grains of the overlying emulsion layer is consistent with observing sharp images in the first, underlying emulsion layer. Obtaining sharp images in the underlying emulsion layer is dependent on the ultrathin tabular grains in the overlying emulsion layer accounting for a high proportion of total grain projected area; however, grains having an ECD of less than 0.2 μm, if present, can be excluded in calculating total grain protected area, since these grains are relatively optically transparent. Excluding grains having an ECD of less than 0.2 μm in calculating total grain protected area, it is preferred that the overlying emulsion layer containing the silver salt epitaxy sensitized ultrathin tabular grain emulsion of the invention account for greater than 97 percent, preferably greater than 99 percent, of the total projected area of the silver halide grains.

Except for the possible inclusion of grains having an ECD of less than 0.2 μm (hereinafter referred to as optically transparent grains), the second emulsion layer consists almost entirely of ultrathin tabular grains. The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 97% and optimally greater than 99% of total grain projected area are satisfied excluding only grains having ECD's of less than 0.1 (optimally 0.05) μm. Thus, in the photographic elements of the invention, the second emulsion layer can consist essentially of tabular grains contributed by the ultrathin tabular grain emulsion of the invention or a blend of these tabular grains and optically transparent grains. When optically transparent grains are present, they are preferably limited to less than 10 percent and optimally less than 5 percent of total silver in the second emulsion layer.

The advantageous properties of the preferred photographic elements of the invention depend on selecting the grains of the emulsion layer overlying a minus blue recording emulsion layer to have a specific combination of grain properties. First, the tabular grains preferably contain photographically significant levels of iodide. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of minus blue light when coupled with an average ECD of at least 0.7 μm, and an average grain thickness of less than 0.07 μm. The mean ECD of at least 0.7 μm, is, of course, advantageous apart from enhancing the specularity of light transmission in allowing higher levels of speed to be achieved in the second emulsion layer. Third, employing ultrathin tabular grains makes better use of silver and allows lower levels of granularity to be realized. Finally, the presence of silver salt epitaxy allows unexpected increases in photographic sensitivity to be realized.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

The following examples illustrate the practice of this invention. They are not intended to be exhaustive of all possible variations of the invention. Parts and percentages are by weight unless otherwise indicated.

All examples involve epitaxially sensitized ultrathin tabular grain emulsions.

The first series of examples demonstrates that sulfodihydroxy aryl type compounds show significant antifoggant behavior when added after sensitization.

The second series of examples demonstrates that addition of sulfodihydroxy aryl compounds prior to chemical sensitization provides greater speed/fog improvements than when added subsequent to sensitization.

The third series of examples demonstrates that the greatest improvement in speed/fog is achieved when a sulfodihydroxy aryl compound, preferably added prior to sensitization, is used in combination with a mercaptotetrazole compound.

Ag(Br,I ) Host Emulsion C. 1.5 Mole-% I in the inner 75%/12 Mole-% I in the outer 25%

A vessel equipped with a stirrer was charged with 6 L of water containing 3.75 g lime-processed bone gelatin, 4.12 g NaBr, an antifoamant, and sufficient sulfuric acid to adjust pH to 5.42 at 39° C. During nucleation, which was accomplished by balanced simultaneous 4 sec. addition of $AgNO_3$ and halide (98.5 and 1.5 mole-% NaBr and KI, respectively) solutions, both at 2.5M, in sufficient quantity to form 0.01335 moles of Ag(Br,I), pBr and pH remained approximately at the values initially set in the reactor solution. Following nucleation, the reactor gelatin was quickly oxidized by addition of 50 cc of a 0.062% NaOCl solution, and the temperature was raised to 54° C. in 9 min. After the reactor and contents were held at this temperature for 9 minutes, 100 g of oxidized lime-processed bone gelatin dissolved in 1.5 L $H_2O$ at 54° C. was added to the reactor. Next 122.5 cc of 1M NaBr was added to the reactor. Twenty four and a half minutes after nucleation, the growth stage was begun during which 2.5 M $AgNO_3$, 2.8M NaBr, and a 0.0394M suspension of AgI were added in proportions to maintain a uniform iodide level of 1.5 mole-% in the growing silver halide crystals, and the reactor pBr at the value resulting from the cited NaBr additions prior to start of nucleation and growth. This pBr was maintained until 0.826 moles of Ag(Br, I) had formed (constant flow rates for 40 min), at which time the excess bromide concentration was increased by addition of 105 cc of 1M NaBr; the reactor pBr was maintained at the resulting value for the balance of the growth. Flow rate of $AgNO_3$ was accelerated during the next 52.5 minutes so that end flow was approximately 10 fold greater than at the start; at the end of this segment, 6.75 moles of AgBr.9851.015 had been formed. In the final growth segment, flow of $AgNO_3$, AgI, and NaBr was continued, but with a more concentrated (0.341M) suspension of AgI, and with reduced initial flow rate of 2.5M $AgNO_3$ (0.25×as great as at the end of 1.5% I growth). During this segment, $AgNO_3$ flow rate was accelerated so that end flow rate was 1.6x that at the start, relative flow rates of $AgNO_3$, AgI, and NaBr were modulated so as to maintain the pBr that prevailed at the end of previous segment, and so as to achieve 12% I in this final 2.25 mole portion. After the final growth segment was completed, the emulsion was then cooled to 40° C, and it was coagulation washed. Finally, pH and pBr were adjusted to storage values of 6 and 2.5, respectively.

The resulting emulsion was examined by scanning electron micrography (SEM), and mean grain area was determined using a Summagraphics SummaSketch Plus sizing tablet that was interfaced to an IBM Personal Computer: 98 number-% of the crystals were tabular, and the equivalent circular diameter of the mean area was 1.70 μm. The mean diameter was 1.50 μm (coefficient of variation=52). Since this emulsion is almost exclusively tabular, the grain thickness was determined using a dye adsorption technique: The level of 1,1'-diethyl-2,2'-cyanine dye required for saturation coverage was determined, and the equation for surface area was solved assuming the solution extinction coefficient of this dye to be 77,300 L/mole cm and its site area per molecule to be 0.566 nm2. This approach gave a thickness value of 0.060 μm.

Sensitization of Host Emulsion C and Photographic Evaluation Procedures

The following procedure was used for epitaxy formation and sensitization, and for evaluation of photographic responses: In each case a suitable quantity of host emulsion was liquified at 40° C. In those cases where disulfocatechol 3,5-disulfocatechol disodium salt (DSC) was present in the sensitization, it was added at this point. Next, dyes 4 and 5 were added and after a suitable hold time the emulsion pBr was adjusted to ca. 4 with a simultaneous addition of $AgNO_3$ and KI solutions in a ratio such that the small amount of silver halide precipitated during this adjustment was 12% I. Next, 2 mole-% NaCl (based on the original amount of Ag(Br, I) host) was added, and then 6 mole-% Ag(Cl Br,I) epitaxy was formed by the following sequence of additions: (levels are mole % per mole of host emulsion) 2.52% chloride added as a $CaCl_2$ solution, 2.52% bromide added as a NaBr solution, 0.000050 moles was then added from a water solution, then 0.96% iodide added as a AgI suspension, and finally 5.04% $AgNO_3$. The post-epitaxy components included 0.75 mg 4,4'-phenyl disulfide diacetanilide, (optionally) additional portions of sensitizing dye, 60 mg NaSCN/mole Ag, 1,3-dicarboxy-methyl-1,3-dimethyl-2-thiourea (disodium salt) (DCT) as sulfur sensitizer, bis(1,4,5-trimethyl-1,2,4-triazolium-3-thiolate) gold(1) tetrafluoroborate (Au(1)TT) as gold sensitizer, and 3.99 mg 3-methyl-1,3-benzothiazolium iodide/mole Ag. After all components were added, the mixture was heated to 50° C. to complete the sensitization, and then chill-set. Samples of the emulsion were then remelted, and appropriate levels of addenda were added prior to coating. As an additional test of stability, separate emulsion samples were subjected to a 4-hour hold at 45° C. prior to coating. Corresponding Dmin values were measured and normalized for by laydown in different coatings. The resulting green sensitized emulsions were coated on cellulose acetate support that had a 4.89 g gelatin/$m^2$ sub layer and REM JET antihalation on the back side. The emulsion layer was overcoated with a 4.3 g/$m^2$ gelatin layer, which also contained surfactant and BVSM hardener (1.75 weight-%, based on total gelatin). Emulsion laydown was 0.538 g Ag/$m^2$. The emulsion layer also contained image dye couplers 3 and 4 at laydowns of 0.32 and 0.016 g/$m^2$, and a total of 1.08 g gelatin/$m^2$ and surfactant. The emulsions so coated were given 0.01" W 9 (green sensitized) filtered daylight balanced light exposures through a 21-step granularity step tablet (0–4 density range), and then were developed using the Kodak Flexicolor (TM) C41 process. The optical density of the resulting dye scales was plotted as a function of log(exposure) (hereinafter referred to as logE). The speed point on such a plot is 0.15 density units above Dmin is reported in a relative units: The speed of the comparison coating is taken as 100, and speed differences relative to that are reported as 100+ (−100× X log(S)) where S is the exposure differ-ence between speed points of comparison and invention coatings. In these units, sensitivity approximately doubles for each gain of 30 speed units. Contrast is the ratio of density change to the corresponding change in logE. Granularity readings on the same processed strips were made according to procedures described in the SPSE Handbook of Photographic Science and Engineering, edited by W. Thomas, pp. 934–939. Granularity readings at each step were divided by the contrast at the same step, and the minimum contrast normalized granularity reading was recorded. Contrast normalized granularity is reported in grain units (g.u.), in which each g.u. represents a 5% change; positive and negative changes corresponding to grainier and less grainy images, respectively (i.e., negative changes are desirable). (This contrast-normalized granularity allows a fairer comparison of coatings having differing contrast than would raw granularity readings.) Since the random dot model for granularity predicts that granularity is inversely proportional to the square root of number of imaging centers (M. A. Kriss in The Theory of the Photographic Proces, 4th ed. T. H. James, ed., New York, Macmillan, 1977; p. 625), and larger grains generally are needed to achieve higher speeds, it is predicted that granularity will increase at a rate of ca. 7 g.u. for each gain of 30 speed units at constant Ag laydown and photoefficiency.

Sensitized Emulsion C1

Emulsion C was green sensitized without DSC. This sensitization employed 1063.7 and 98.4 respectively of Dyes 3 and 4 per mole host emulsion, and 2.37 and 0.69 mg, respectively of DCT and Au(1)TT per mole of host emulsion.

Sensitized Emulsion C2

In this case, Emulsion C was green sensitized in exactly the same manner as was C1, except in this case 2.0 g of DSC per mole of host emulsion was added at the start of sensitization.

TABLE 3

Effect of Post Sensitization additions of and DSC (Sensitized Emulsion C1)

| Example | APMT (mM/M) | DSC (g/mole) | Speed | Dmin | Granularity | Dmin after hold |
|---|---|---|---|---|---|---|
| 9 (Comp) | 0 | 0 | 100 | 0.22 | check | 0.44 |
| 10 (Inv) | 0 | 2.0 | 101 | 0.17 | −1.8 | 0.39 |

These results demonstrate that DSC has antifoggant capability, and moreover that it also improves speed/granularity performance.

TABLE 4

Comparison of the Effects of Adding DSC Prior to or after Sensitization (Sensitized Emulsions C1 and C2)

| Example | DSC (g/mole) | When Added | Speed | Dmin | Granularity | Dmin after hold |
|---|---|---|---|---|---|---|
| 11 (Comp) | 0 | — | 100 | 0.22 | check | 0.44 |
| 12 (Inv) | 2.0 | after | 101 | 0.17 | −1.8 | 0.39 |
| 13 (Inv) | 2.0 | prior | 111 | 0.14 | −2.3 | 0.35 |

These results demonstrate that significant speed/Dmin/granularity benefits, and some improvement in melt hold stability result from addition of DSC, especially when added prior to chemical sensitization.

TABLE 5

Comparison of DSC to DSC and APMT (DSC was added prior to sensitization, APMT was added afterward) (Sensitized Emulsions C1, and C2)

| Example | DSC (g/mole) | APMT (mM/M) | Speed | Dmin | Granularity | Dmin after hold |
|---|---|---|---|---|---|---|
| 14 (comp) | 0 | 0 | 100 | 0.22 | check | 0.44 |
| 15 (Inv) | 2.0 | 0 | 111 | 0.14 | −2.3 | 0.35 |
| 16 (Inv) | 2.0 | 0.48 | 111 | 0.09 | −3.6 | 0.09 |

These results demonstrate that significant benefits in speed/Dmin, granularity, and melt hold stability result from the combination of DSC and APMT.

These examples demonstrate that sulfodihydroxy aryl compounds are effective antifoggants for epitaxially sensitized emulsions and that they offer a concommitant improvement in speed/granularity performance, expecially when such compounds are present during sensitization. Finally these results demonstrate superior antifoggant behavior for epitaxially sensitized emulsions from the combination of sulfodihydroxy aryl and mercaptotetrazole compounds, which combination also gives the best speed/granularity performance and lowest Dmin after a melt hold treatment.

APPENDIX

Dye 4

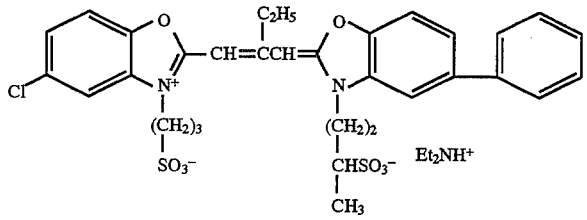

Dye 5

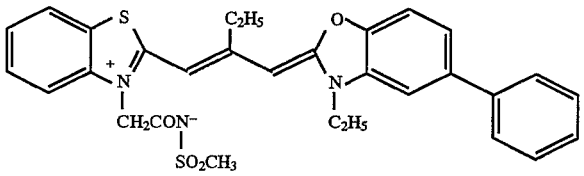

Coupler 3

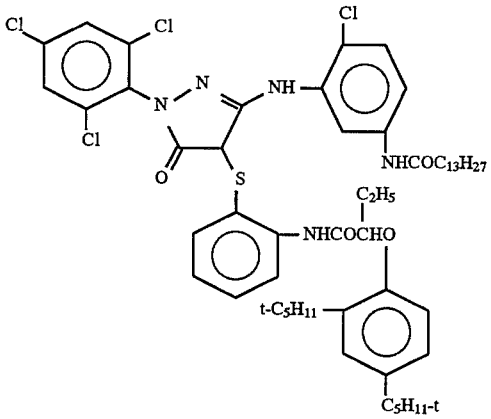

-continued
APPENDIX

Coupler 4

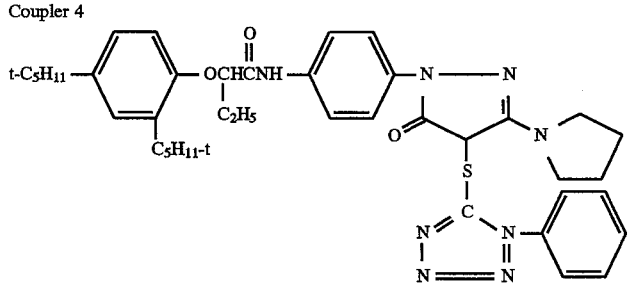

The invention has been described in detail with particular reference to preferred embodiments thereof, but it will be understood that variations and modifications can be effected within the spirit and scope of the invention.

We claim:

1. A radiation-sensitive silver halide emulsion comprising silver halide tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and a spectral sensitizing dye adsorbed to the surfaces of the tabular grains, wherein the surface chemical sensitization sites include at least one chemically sensitized silver salt epitaxially located on less than 50 percent of the surface of said tabular grains and said emulsion further comprising at least one sulfodihydroxy aryl compound represented by the Formulas I or II

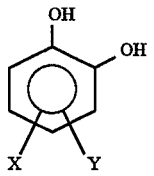

(Formula I)

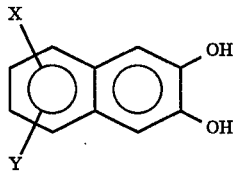

(Formula II)

wherein

X and Y represent an $SO_3$ group or a hydrogen with at least one of X and Y being a sulfo group wherein the silver salt is predominantly located adjacent at least one of the edges and corners of the tabular grains.

2. The emulsion according to claim 1 wherein the tabular grains include at least 0.25 mole percent iodide, based on silver.

3. The emulsion according to claim 2 wherein the tabular grains are silver iodobromide grains.

4. The emulsion according to claim 1 wherein the silver salt is comprised of a silver halide.

5. The emulsion according to claim 4 wherein the silver salt is comprised of silver chloride.

6. The emulsion according to claim 4 wherein the silver salt is comprised of silver bromide.

7. The emulsion according to claim 1 wherein the tabular grains account for greater than 97 percent of total grain projected area.

8. The emulsion according to claim 1 wherein the tabular grains contain a photographically useful dopant.

9. The emulsion of claim 1 further comprising a mercapto compound represented by Formula III

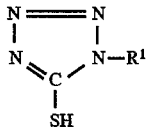

Formula III where $R^1$ is an aliphatic or aromatic radical containing up to 20 carbon atoms.

10. The emulsion of claim 9 wherein said mercaptotetrazole comprises 1-(3-acetamidophenyl)-5-mercaptotetrazole.

11. The emulsion of claim 9 wherein $R^1$ is an alkyl radical.

12. The emulsion of claim 9 wherein the $R^1$ comprises an alkyl or aryl radical substituted with alkoxy, phenoxy, halogen, cyano, nitro, amino, substituted amino, sulfo, sulfamyl, substituted sulfamyl, sulfonylphenyl, sulfonylalkyl, fluorosulfonyl, sulfonamidophenyl, sulfonamidoalkyl, carboxy, carboxylate, ureido carbamyl, carbamylphenyl, carbamylalkyl, carbonylalkyl, and carbonylphenyl.

13. The emulsion of claim 1 wherein said sulfodihydroxy aryl compound comprises at least one of Compound I-1: 3,5-disulfo-catechol disodium salt or 4,5-dihydroxy benzene-1,3-disulfonic acid disodium salt Compound I-2: 4-sulfocatechol ammonium salt Compound II-1: 2,3-dihydroxy-7-sulfonaphthalene sodium salt Compound II-2: 2,3-dihydroxy-6,7-disulfonaphthalene potassium salt.

14. The photographic element comprising at least one layer comprising a radiation-sensitive silver halide emulsion comprising silver halide tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, and a spectral sensitizing dye adsorbed to the surfaces of the tabular grains, wherein the surface chemical sensitization sites include at least one chemically sensitized silver salt epitaxially located on less than 50 percent of the surface of said tabular grains and said emulsion further comprising at least one sulfodihydroxy aryl compound represented by the Formulas I or II

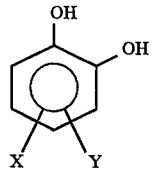

(Formula I)

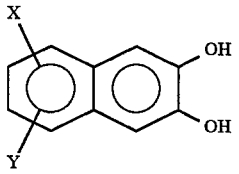

(Formula II)

wherein

X and Y represent an $SO_3$ group or a hydrogen with at least one of X and Y being a sulfo group wherein the silver Salt is predominantly located adjacent at least one of the edges and corners of the tabular grains.

15. The element of claim 16 further comprising a mercapto compound represented by Formula III

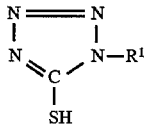

Formula III where $R^1$ is an aliphatic or aromatic radical containing up to 20 carbon atoms.

* * * * *